US010370144B2

(12) United States Patent
Wang

(10) Patent No.: US 10,370,144 B2
(45) Date of Patent: Aug. 6, 2019

(54) FOLDABLE TRAY

(71) Applicant: TECHCYCLE PACKAGING TECHNOLOGY (SHANGHAI) CO., LTD., Shanghai (CN)

(72) Inventor: Hualong Wang, Shanghai (CN)

(73) Assignee: TECHCYCLE PACKAGING TECHNOLOGY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 15/772,621

(22) PCT Filed: Dec. 13, 2016

(86) PCT No.: PCT/CN2016/109703
§ 371 (c)(1),
(2) Date: May 1, 2018

(87) PCT Pub. No.: WO2017/101757
PCT Pub. Date: Jun. 22, 2017

(65) Prior Publication Data

US 2019/0118999 A1 Apr. 25, 2019

(30) Foreign Application Priority Data

Dec. 17, 2015 (CN) ..... 2015 1 0955091

(51) Int. Cl.
*B65D 19/00* (2006.01)
*B65D 19/06* (2006.01)
*B65D 19/44* (2006.01)

(52) U.S. Cl.
CPC ..... *B65D 19/06* (2013.01); *B65D 19/44* (2013.01); *B65D 2519/0093* (2013.01);
(Continued)

(58) Field of Classification Search
CPC ..... B65D 19/06; B65D 19/44; B65D 85/48; B65D 2519/00502; B65D 2519/00641;
(Continued)

(56) References Cited

U.S. PATENT DOCUMENTS 4,512,473 A * 4/1985 Thomaswick ..... B65D 85/48 206/448
4,662,532 A * 5/1987 Anderson ..... B65D 19/12 220/1.5

(Continued)

*Primary Examiner* — Luan K Bui
(74) *Attorney, Agent, or Firm* — Li & Cai Intellectual Property (USA) Office

(57) ABSTRACT

A foldable tray comprises a baseplate, and a first side plate and a second side plate symmetrically arranged on the baseplate, both hingedly connected to the baseplate, and lie on the baseplate after being folded, and are height-adjustable side plates. An extension side plate that can be stretched out from the side plate is arranged at the top of the first and second side plates. The stretching height of the extension side plate is controlled by a prepositioning apparatus arranged in the first and second side plates. A side plate folding lock is arranged on the first and second side plates. The tray comprises roller shutter side plates symmetrically arranged on the baseplate and rolled in roller shutter storage apparatuses located in the baseplate, and can be pulled out under the action of external force. When the external force disappears, the roller shutter side plates can automatically retract.

10 Claims, 12 Drawing Sheets

(52) U.S. Cl.
CPC ..... *B65D 2519/0096* (2013.01); *B65D 2519/0099* (2013.01); *B65D 2519/00502* (2013.01); *B65D 2519/00641* (2013.01); *B65D 2519/00875* (2013.01)

(58) Field of Classification Search
CPC .. B65D 2519/00875; B65D 2519/0096; B65D 2519/0099
USPC ..... 206/386, 448, 557, 600; 211/195; 220/1.5, 6, 7
See application file for complete search history.

(56) References Cited

U.S. PATENT DOCUMENTS

2002/0179601 A1* 12/2002 Haruhiro ..... B65D 11/1833 220/6
2003/0164318 A1* 9/2003 Lacasse ..... B65D 85/48 206/448
2004/0168946 A1* 9/2004 Angeletti ..... B65D 19/44 206/448
2004/0222222 A1* 11/2004 Parnall ..... B65D 11/1833 220/6
2006/0260976 A1* 11/2006 Apps ..... B65D 19/18 206/600
2008/0169285 A1* 7/2008 Marazita ..... B65D 19/18 220/7
2009/0134057 A1* 5/2009 Hidalgo Vargas ..... B65D 11/1833 206/600

* cited by examiner

FOLDABLE TRAY

BACKGROUND

1. Technical Field

The present disclosure relates to a tray, in particular to a foldable tray.

2. Description of Related Art

At present, in the field of logistics transportation, the tray, which includes a bottom plate and a side frame arranged on the bottom plate, is widely-accepted popular due to the fact that goods in bulk or with small packages are convenient to be loaded by the tray. Most of the side frames of the traditional tray are fixed to the bottom plate in a non-foldable mode, so that when the tray is empty, the space occupied by the tray is the same as that of the full load and the storage space of the tray is not easy to be saved, thus resulting in that the tray is not suitable for piling articles no matter in a no-load state or a full-load state. In addition, when the multi-layer stacking of the trays is not stable enough, the risk of overturning caused by the action of external force is easily caused in the transportation process.

In addition, the height of the existing trays for stacking cargoes is limited and cannot be changed according to the requirement of the height of cargoes, and the universality of conventional trays is thus poor.

Furthermore, the conventional tray's side frames are made of metal materials, so that the cost is high, the weight is large, and the use and the maintenance are not convenient.

SUMMARY

For the sake of resolving the technical problems, the present disclosure provides a device which is simple in structure and convenient to use, and is easy to fold and does not occupy space when being stored.

In order to achieve the abovementioned aim, the technical solution of the present disclosure is as follows.

A foldable tray is provided, including a baseplate, and a first side plate and a second side plate arranged on any two opposite edge of the baseplate; wherein the first and second side plates are both hingedly connected to the baseplate, and lie on the baseplate after being folded in an overlapping manner; wherein, the first and second side plates are height-adjustable side plates, an extension side plate that is stretched out from the interior of the side plate is arranged at the top of each of the first and second side plates; the stretching height of the extension side plate is controlled by a prepositioning apparatus arranged in each of the first and second side plates; a movable cross rod is disposed on the extension side plate for fixing an article; wherein, a side plate folding lock is arranged on each of the first and second side plates for controlling opening or closing the first and second side plates; wherein the tray further includes roller shutter side plates arranged on the other two opposite edges of the baseplate; the roller shutter side plates are rolled in roller shutter storage apparatuses located in the baseplate, and are pulled out under the action of an external force, and when the external force disappears, the roller shutter side plates automatically retract.

In an exemplary embodiment of the present disclosure, the hinge joint of the first side plate and the baseplate is lower than the hinge joint of the second side plate and the baseplate, and a height difference between the hinge joints is equal to the thickness of the first side plate.

In an exemplary embodiment of the present disclosure, the prepositioning apparatus includes a spanner, a fixed block disposed on the spanner, a steel rod connected with two ends of the fixed block, and a steel rod resetting apparatus disposed at two ends of the steel rod; an angle between the fixed block and the steel rod is between 0-90°; wherein a plurality of prepositioning holes are arranged at two sides of the extension side plate at intervals; the end of the steel rod of the prepositioning apparatus is clamped in the uppermost prepositioning hole when the extension side plate is in the original position; when the extension side plate needs to be lifted up, the spanner is rotated to enable the steel rod of the prepositioning apparatus to detach from the prepositioning hole; and when the extension side plate is lifted up to a predetermined height, the spanner is loosened, so that the end of the steel rod is clamped in the prepositioning hole to provide the positioning effect because of the function of the steel rod resetting apparatus.

In an exemplary embodiment of the present disclosure, the side plate folding lock includes a foot lever, a spacing ring sleeved in the middle of the foot lever, two turning wheels arranged at two opposite sides of the foot lever, two lanyards connected with the foot lever, and a lock buckle arranged at two ends of the lanyard; wherein the foot lever is movable up and down in the spacing ring; a spring is disposed between the foot lever and the spacing ring; one end of the lanyard is fixedly arranged at the bottom of the foot lever and the other end of the lanyard is connected to the lock buckle through the turning wheels; wherein a block sheet is disposed between the lock buckle and the lanyard, and the lanyard passes through the block sheet to connect with the lock buckle; wherein a portion of the lanyard between the block sheet and the lock buckle is sleeved with a spring; when the first side plate and the second side plate are in the opening state, one end of the lock buckle is clamped in the bayonet of the L-shaped baffle plate, so that the first side plate and the second side plate are not foldable; and when stepping the pedal surface, the foot lever drives the lanyard to retract, and the lanyard pulls the lock buckle out of the foldable tray, so that the first side plate and the second side plate are foldable.

In an exemplary embodiment of the present disclosure, the foldable tray further includes a roller shutter side plates fixed device disposed in the drag rod of the extension side plate; wherein the roller shutter side plates fixed device includes a handle, a lanyard connected with the handle, and a lock block connected with the lanyard; wherein a stop block is disposed between the lanyard and the lock block, the lanyard passes through the stop block to connect to the lock block, and the lanyard is disposed with a spring arranged in a region between the stop block and the lock block.

In an exemplary embodiment of the present disclosure, the foldable tray further includes a rope for supporting an enclosure wall of the foldable tray; wherein the pull-out end of the rope is provided with a rope pin; when the rope is not in use, the rope is rolled in a rope storage device; and wherein a turbine spring is used in the rope storage device, so that the rope retracts automatically when the rope is not in use.

In an exemplary embodiment of the present disclosure, the foldable tray further includes a rope fixer, and wherein the rope fixer includes a fixed component and a rope unidirectional limiting device disposed on the foldable tray; wherein the fixed component is used to fix the rope pin, and the rope unidirectional limiting device is arranged at the exit of the rope and includes a clamping member through which the rope passes, an eccentric wheel having a handle arranged in the clamping member, and a spring of which one end is connected with the clamping member and the other end is connected to the eccentric wheel, and wherein the eccentric wheel is rotatable in the clamping member through a rotating axis; when the spring is stretching, the eccentric wheel is far away from the rope, and the rope is pulled out, and when the spring retracts, the eccentric wheel returns to its original position and abuts against the rope for limiting the position of the rope.

In an exemplary embodiment of the present disclosure, a lower end surface of the lock block is an arc shape.

In an exemplary embodiment of the present disclosure, an end of the rope pin is disposed with a recess, the fixed component is a hollow cylindrical structure, and a clamp spring is fixed on the inner wall of the hollow cylindrical structure.

In an exemplary embodiment of the present disclosure, a contact surface where the eccentric wheel contacts with the rope is an arc-shaped structure having a small diameter in the upper part and a large diameter in the lower part.

By virtue of the technical solutions provided above, the present disclosure has the following advantages.

The first side plate and the second side plate of the foldable tray of the present disclosure are height-adjustable side plates, so they can satisfy various requirements of articles having different heights. The side plates are respectively provided with a prepositioning apparatus for confirming and instantly controlling the lifting height of the side plates. Further, the first side plate and the second side plate provided in the present disclosure are foldable, so that they are free of occupied space in storage and advantageous to the storage and transport of the foldable tray. In addition, the roller shutter side plates are employed by the other two side plates and rolled to be stored in the baseplate, and are simply pulled out when in use, so that they have advantages of light weight, low cost, and fixing stability.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

Figure 1:
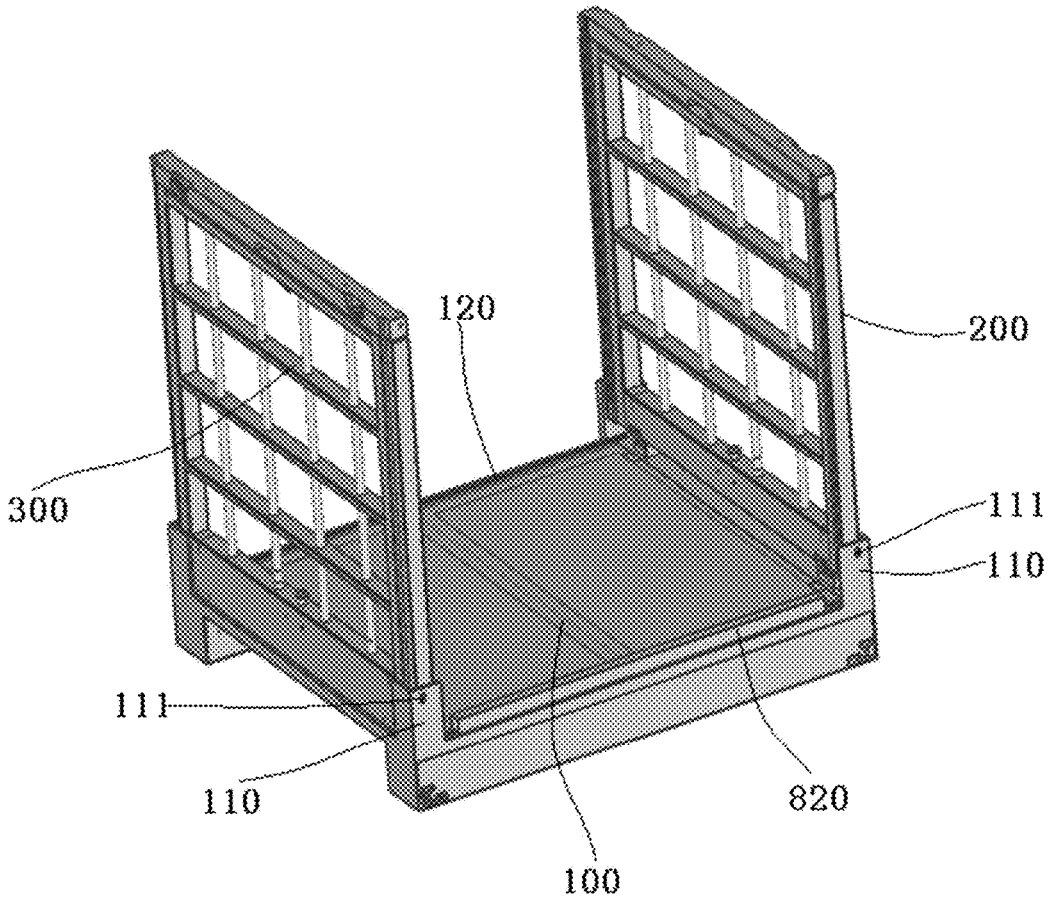
FIG. 1 is a schematic diagram of the tray according to the present disclosure.

Reference numeral: baseplate 100, L-shaped baffle plate 110, bayonet 111, long recess 120, first side plate 200, thick inner side frame 210, top frame 220, bottom frame 230, thick outer side frame 240, thick tubes 250, second side plate 300, hinge joint 400, extension side plate 500, thin outer side frame 510, prepositioning hole 511, drag rod 520, handle groove 521, thin tube 530, rectangular clamping groove 540, movable cross rod 550, cross rod 551, through hole 551*a*, long rope 552, prepositioning apparatus 600, spanner 610, fixed block 620, steel rod 630, sleeve ring 640, cover plate 650, spring 660, side plate folding lock 700, foot lever 710, spacing ring 720, turning wheel 730, lanyard 740, lock buckle 750, block sheet 760, spring 770, roller shutter side plates 800, roller shutter storage apparatuses 810, pull plate 820, extension end 821, notch 822, lock hole 823, support rod 830, roller shutter side plates fixed device 900, handle 910, handle recess 911, lanyard 920, lock block 930, stop block 940, spring 950, rope 1000, rope pin 1100, slot 1110, rope storage device 1200, turbine spring 1210, fixed component 1300, clamp spring 1310, rope unidirectional limiting device 1400, clamping member 1410, eccentric wheel 1420, spring 1430.

DESCRIPTION OF THE EXEMPLARY EMBODIMENTS

Reference will now be made in detail to the exemplary embodiments of the present disclosure, examples of which are illustrated in the accompanying drawings. Wherever possible, the same reference numbers are used in the drawings and the description to refer to the same or like parts.

Reference is made to FIG. 1. The present disclosure provides a foldable tray, including a baseplate 100, and a first side plate 200 and a second side plate 300 symmetrically arranged on any two opposite edges of the baseplate 100. Each end angle of the baseplate 100 is disposed with an L-shaped baffle plate 110. One side surface of each L-shaped baffle plate 110 is disposed with a bayonet 111. The first side 200 and the second side plate 300 are both hingedly connected to the baseplate 100 through hinge joints 400. The hinge joint of the first side plate 200 and the baseplate 100 is lower than the hinge joint of the second side plate 300 and the baseplate 100. A height difference between the hinge joints is equal to the thickness of the first side plate 200. The first side plate 200 and the second side plate 300 lie on the baseplate 100 after being folded in an overlapping manner because of the height difference, thereby enabling the first side plate 200 and the second side plate 300 to lie on the baseplate 100 after being folded. By means of the structure provided in the present disclosure, the foldable tray has the advantages of small space occupation and easy transportation, and is extremely-attractive when multiple trays are stacked.

Figure 2:
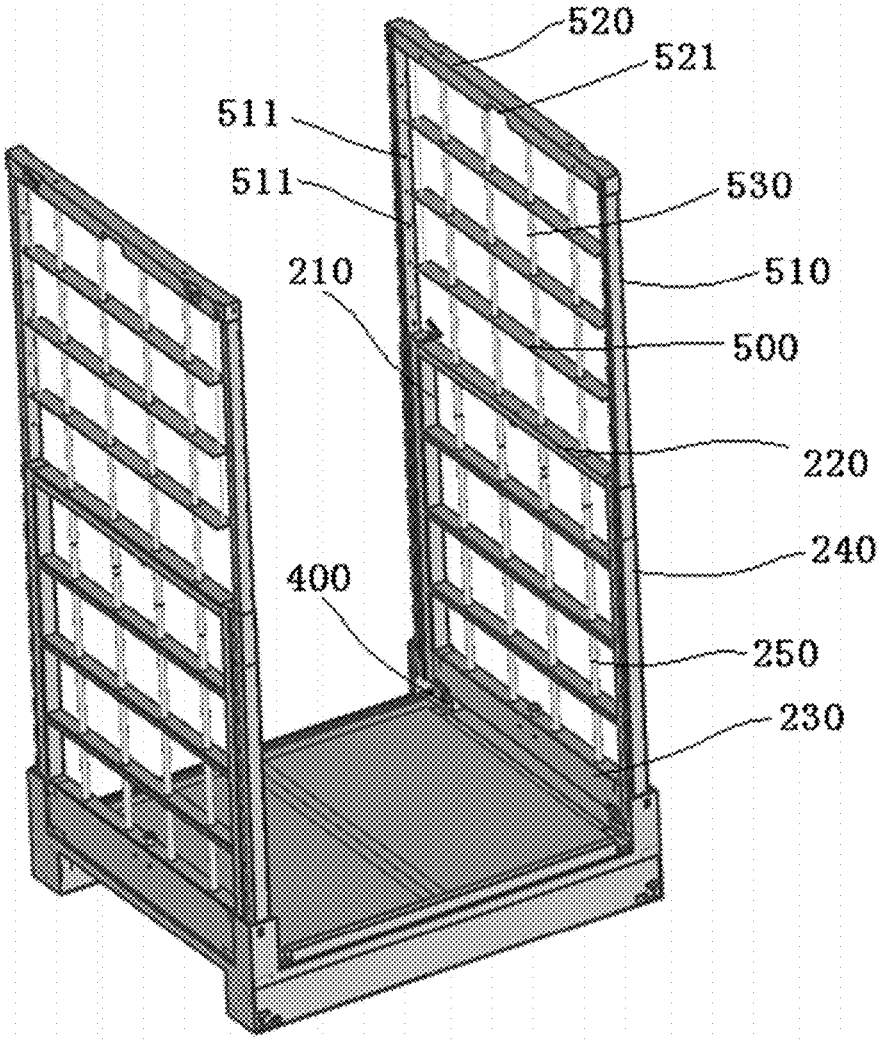
FIG. 2 is a schematic diagram of the extension side plate according to the present disclosure when being folded.

Reference is made to FIG. 2. The first side plate 200 and the second side plate 300 are height-adjustable side plates. An extension side plate 500 that is stretchable out from the interior of the side plate is arranged at the top of each of the first side plate 200 and the second side plate 300. The height of the extension side plate 500 can be adjusted according to practical requirements, and the present disclosure is not limited thereto. The first side plate 200 and the second side plate 300 substantially have the same structure, and respectively include two thick inner side frames 210, a top frame 220, a bottom frame 230, two thick outer side frames 240 and thick tubes 250 formally disposed inside the thick inner side frames 210, in which the thick outer side frames 240 and the thick inner frames 210 are arranged in a staggered manner. After the first side plate 200 and the second side plate 300 are folded, the thick outer side frames 240 are in a long recess 120 on the baseplate 100. One end of each thick tube 250 is connected to the top frame 220 and the other end of each thick tube 250 is connected to the bottom frame 230. Each of the thick outer side frames 240 and each of the thick tubes 250 are of a hollow structure. Each extension side plate 500 includes two thin outer side frames 510 sleeved inside the two thick outer side frames 240, a drag rod 520 connected to the top end of the two thin outer side frames 510 and thin bars 530 formally disposed inside the thin outer side frames 510 and sleeved inside the thick tubes 250. When not in use, the extension side plate 500 can be placed inside the first side plate 200 or the second side plate 300 to save space. In addition, a handle groove 521 is disposed in the middle of the drag rod 520, and the user can hold the handle groove 521 when adjusting the height of the extension side plate 500, thus promoting the usage convenience.

Figure 3:
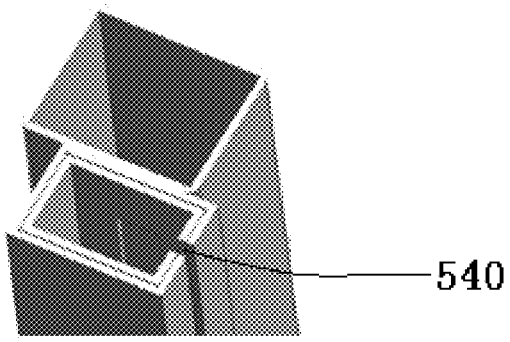
FIG. 3 is a cross-sectional diagram of the thick outer frame and the thin outer frame according to the present disclosure.

As shown in FIG. 3, each thick outer side 240 and each thin outer side frame 510 are of a hollow structure, and have a rectangular clamping groove 540 for allowing roller shutter side plates to move therein along the height direction.

Figure 4:
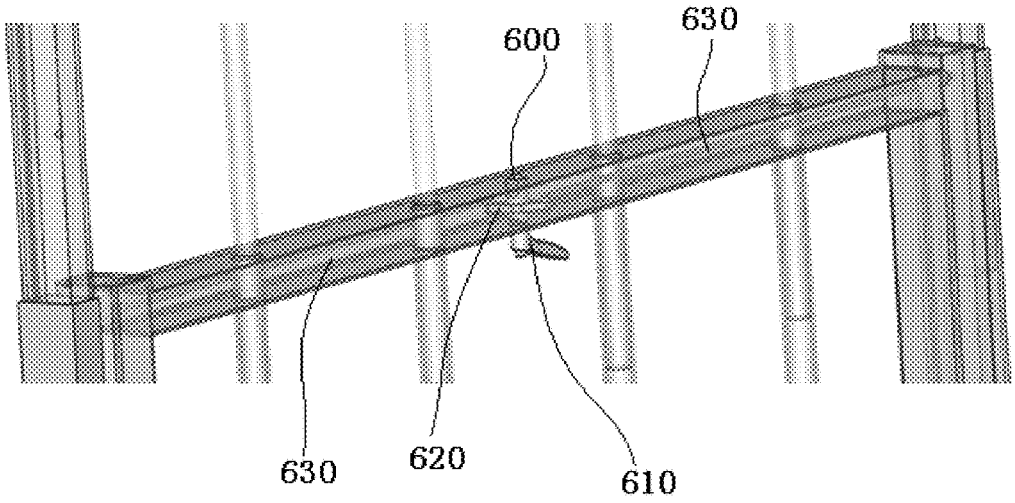
FIG. 4 is a schematic diagram of the installment of the prepositioning apparatus according to the present disclosure.
Figure 5:
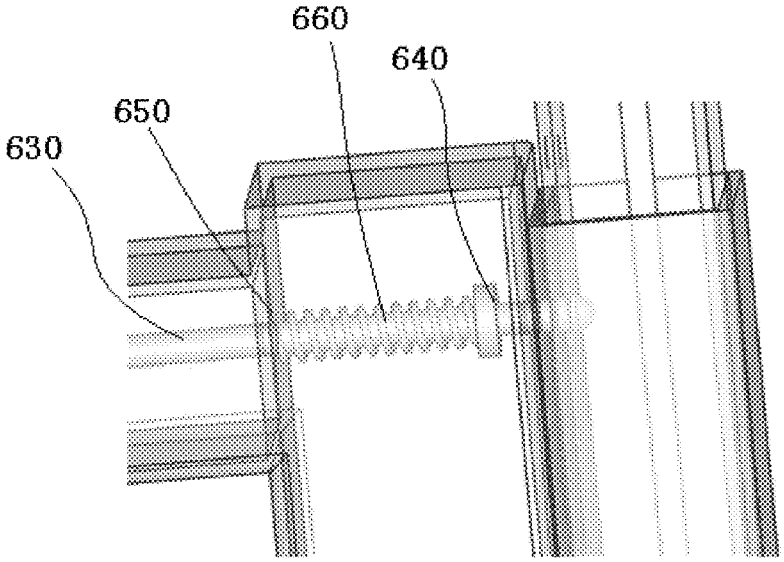
FIG. 5 is an enlarged view of a part of FIG. 4.
Figure 6:
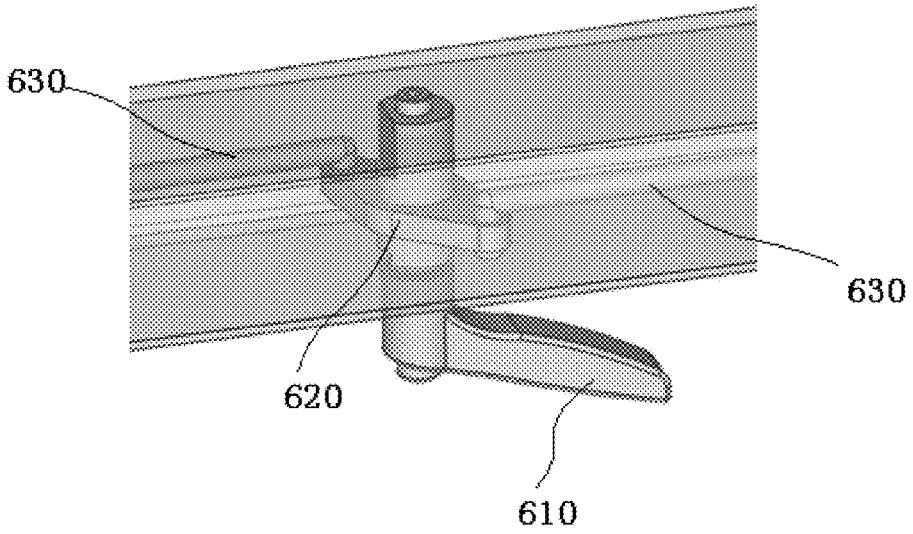
FIG. 6 is another enlarged view of a part of FIG. 4.

Reference is made to FIG. 4 to FIG. 6. The stretching height of the extension side plate 500 is controlled by a prepositioning apparatus 600 arranged in each of the first side plate 200 and the second side plate 300. The prepositioning apparatus 600 includes a spanner 610, a fixed block 620 disposed on the spanner 610, a steel rod 630 connected with two ends of the fixed block 620, and a steel rod resetting apparatus disposed at two ends of the steel rod 630. The steel rod resetting apparatus is composed of a sleeve ring 640 fixedly sleeved at the end of the steel rod 630, a cover plate 650 fixedly disposed in the top frame 220 and a spring 660. The steel rod 630 passes through an opening at the middle of the cover plate 650, the spring 660 is sleeved and disposed on the steel rod 630 between the sleeve ring 640 and the cover plate 650, and the spring 660 is stretched or compressed only between the sleeve ring 640 and the cover plate 650. An angle between the fixed block 620 and the steel rod 630 is between 0-90°, thereby facilitating the adjustment of the length of the steel rod 630. The fixed block 620, the steel rod 630 and the steel rod resetting apparatus are disposed in the top frame 220. One end of the spanner 610 is connected with the fixed block 620, and the other end of the spanner 610 extends from the top frame 220 and is located at the outside of the lower bottom surface of the top frame 220, thereby facilitating the manual operation and promoting the usage convenience. In addition, a plurality of prepositioning holes 511 are arranged on the thin outer side frames 510 at two sides of the extension side plate 500 at intervals. The end of the steel rod 630 of the prepositioning apparatus 600 is clamped in the uppermost prepositioning hole 511 of the thin outer side frame 510 of the extension side plate 500 when the extension side plate 500 is in the original position, that is, before being stretched. When the height of an article stored in the tray is higher than the height of the first side plate 200 and the second side plate 300, the extension side plate 500 needs to be lifted up. The operation is as follows. The spanner 610 is rotated, and then the fixed block 620 is driven by the spanner 610 to rotate. The fixed block 620 and the steel rod 630 have an angle difference therebetween, so the steel rod 630 at two ends of the fixed block 620 can be pulled out of the prepositioning hole 511 while the spring 660 is compressed between the sleeve ring 640 and the cover plate 650. When the extension side plate 500 is lifted up to a predetermined height, the spanner 660 is loosened. After that, the end of the steel rod 630 is clamped and then positioned in the prepositioning hole 511 due to the reset action of the spring 660.

Figure 7:
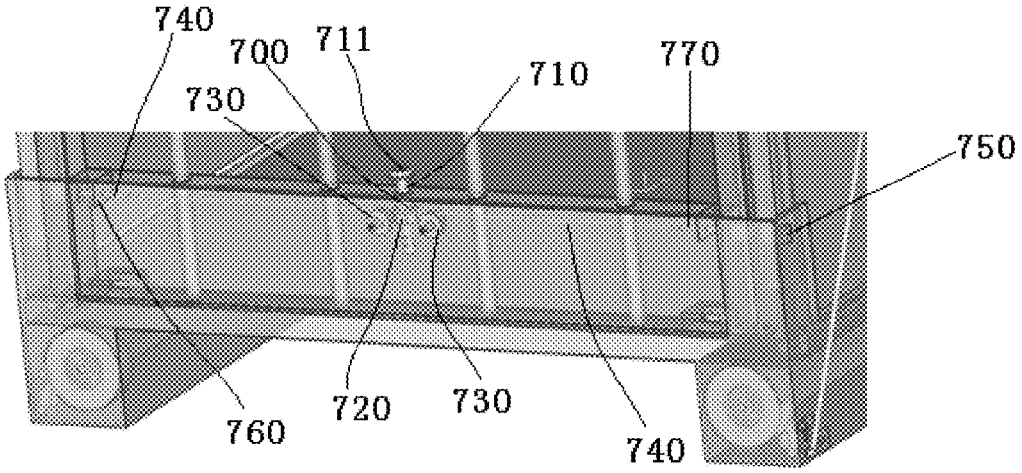
FIG. 7 is a schematic diagram of the installment of the side plate folding lock according to the present disclosure.
Figure 8:
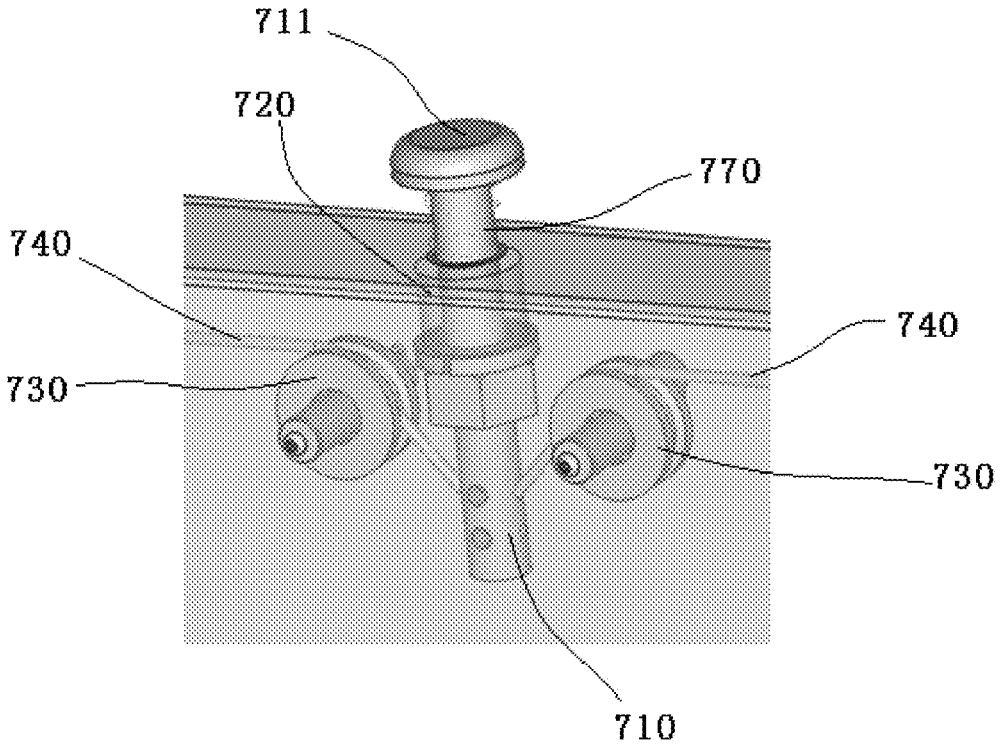
FIG. 8 is an enlarged view of a part of FIG. 7.
Figure 9:
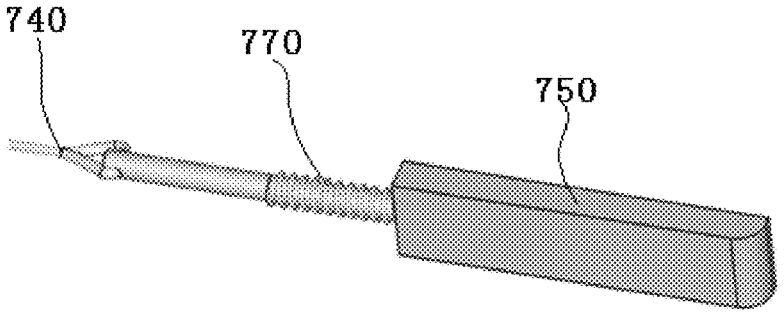
FIG. 9 is another enlarged view of a part of FIG. 7.

Reference is made to FIG. 7 to FIG. 9. The first side plate 200 and the second side plate 300 provided in the present disclosure are foldable, so a side plate folding lock 700 is arranged on each of the first side plate 200 and the second side plate 300 for controlling the opening and closing of the first side plate 200 and the second side plate 300. The side plate folding lock 700 includes a foot lever 710, a spacing ring 720 sleeved in the middle of the foot lever 710, two turning wheels 730 arranged at two opposite sides of the foot lever 710, two lanyards 740 connected with the foot lever 710 and a lock buckle 750 arranged at two ends of the lanyard 740. The spacing ring 720, the turning wheels 730, the lanyards 740 and the lock buckle 750 are all disposed in the bottom frame 230, and the spacing ring 720 and the turning wheels 730 are fixedly connected with the bottom frame 230. The foot lever 710 is movable up and down in the spacing ring 720. One end of the foot lever 710 is in the bottom frame 230 and the other of the foot lever 710 is at outside of the upper surface of the bottom frame 230, and there is a gap between one end of the foot lever 710 in the bottom frame 230 and the bottom of the bottom frame 230. A spring 770 is disposed between the foot lever 710 and the spacing ring 720, and the spring 770 is sleeved on the foot lever 710. A pedal surface 711 is arranged at the top of the foot lever 710, and the diameter of the pedal surface 711 is larger than the foot lever 710, so that the spring 770 is compressed only within the range of the foot lever 710 between the pedal surface 711 and the spacing ring 720. One end of the lanyard 740 is fixedly arranged at the bottom of the foot lever 710 and the other end of the lanyard 740 is connected to the lock buckle 750 through the turning wheels 730. A block sheet 760 is disposed between the lock buckle 750 and the lanyard 740, and the block sheet 760 is fixed on the bottom frame 230. A through hole is disposed in the middle of the block sheet 760, and the lanyard 740 passes through the through hole in the middle of the block sheet 760 to connect with the lock buckle 750. The portion of the lanyard 740 between the block sheet 760 and the lock buckle 750 is sleeved with the spring 770, and the spring 770 is compressed only between the block sheet 760 and the lock buckle 750. When the first side plate 200 and the second side plate 300 are in the opening state, one end of the lock buckle 750 is clamped in the bayonet 111 of the L-shaped baffle plate 110. Because the L-shaped baffle plate 110 is fixed on the baseplate 100, the first side plate 200 and the second side plate 300 are not able to be folded. When stepping the pedal surface 711, the spring 770 on the foot lever 710 is compressed, the foot lever 710 drives the lanyard 740 to retract, and the lanyard 740 pulls the lock buckle 750 out of the bayonet 111 of the L-shaped baffle plate 110, so that the first side plate 200 and the second side plate 300 are able to be folded. When the first side plate 200 and the second side plate 300 are opened from the folded state, the lock buckle 750 is clamped to the bayonet 111 of the L-shaped baffle plate 110 to lock the first side plate 200 and the second side plate 300 under the action of an external force.

Figure 10:
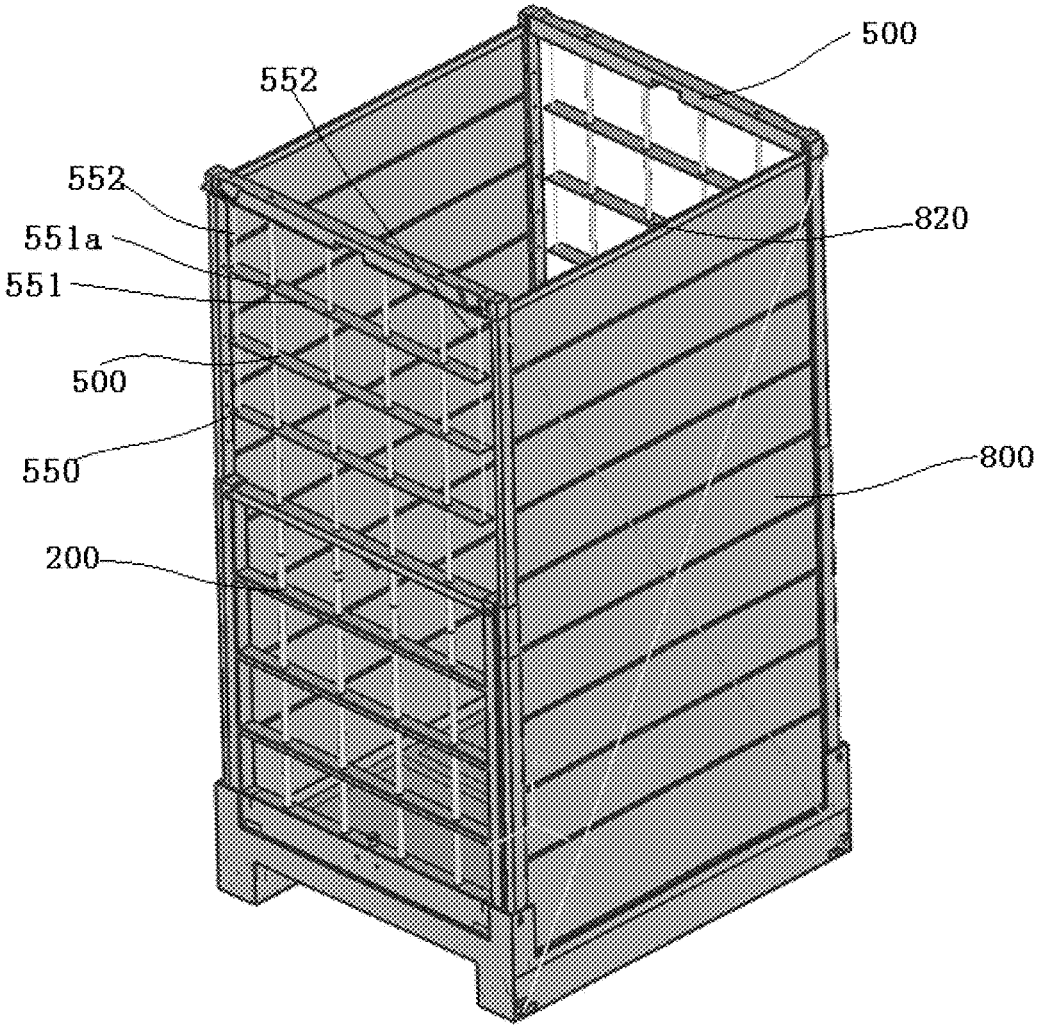
FIG. 10 is a structural diagram of the enclosure wall formed by the roller shutter side plates, the first side plate and the second side plate according to the present disclosure.

As shown in FIG. 10, the foldable tray of the present disclosure further includes roller shutter side plates 800 arranged on the other two opposite edges of the baseplate 100. The roller shutter side plates 800, the first side plate 200, the second side plate 300 and the extension side plate 500 together form an enclosure wall to fix an article. The height of the roller shutter side plates 800 can be flexibly adjusted according to the maximum height of the extension side plate 500 of the foldable tray, and unnecessary details are not repeated herein.

Figure 11:
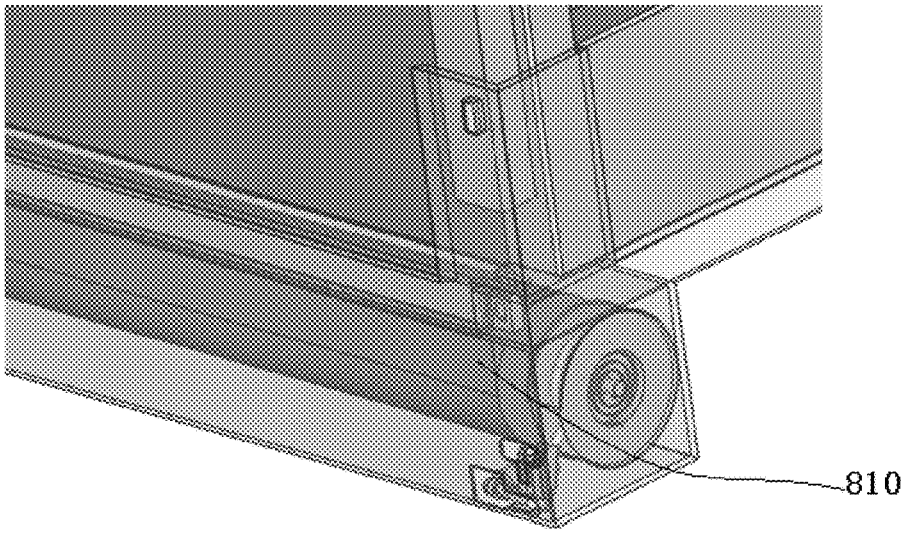
FIG. 11 is a schematic diagram of the installment of the roller shutter side plates storage device according to the present disclosure.

As shown in FIG. 11, the roller shutter side plates 800 are rolled in roller shutter storage apparatuses 810 located in the baseplate 100 before being pulled out, and can be pulled out under the action of external force; and when the external force disappears, the roller shutter side plates 800 can automatically retract.

Figure 12:
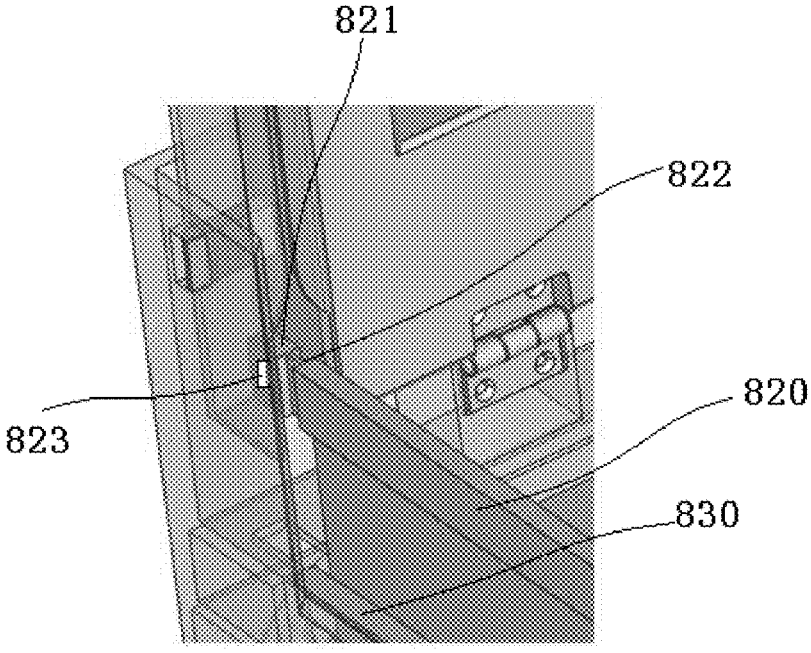
FIG. 12 is a schematic diagram of a part of the roller shutter side plates storage device according to the present disclosure.

Reference is made to FIG. 12. The width of the roller shutter side plates 800 is equal to a gap between the first side plate 200 and the second side plate 300, and one end of the roller shutter side plates 800 is fixed on the roller shutter storage apparatuses 810 and the other end of the roller shutter side plates 800 is a pull plate 820. A long recess 120 through which the roller shutter side plates 800 can pass is arranged on the baseplate 100. The pull plate 820 is located inside the long recess 120, and the width of the long recess 120 is set to be only for the thick outer side frame 240 being placed therein and for the convenience of enabling user's fingers to stretch therein to pull out the pull plate 820. Two ends of the pull plate 820 extend outwardly to form a notch 822 and have an extension end 821 capable of moving up and down in the thick outer side frame 240 and the thin outer side frame 510, and the notch 822 on the extension end 821 is clamped in the rectangular clamping groove 540 of the thick outer side frame 240 and the thin outer side frame 510. Such a structure can limit the moving path of the roller shutter side plates 800, thereby promoting the stability in use. In addition, a lock hole 823 is arranged on the extension end 821, and a plurality of support rods 830 are arranged along the length direction of the roller shutter side plates 800 at intervals. The structure of each support rod 830 and the structure of the pull plate 820 are substantially the same. The difference is that the extension end of two ends of the support rod 830 is shorter than the extension end 821 of two ends of the pull plate 820, so that the support rod 830 can be clamped in the rectangular clamping groove 540 of the thick outer side frame 240 and the thin outer side frame 510. However, the support rod 830 is provided without a lock hole 823 and is not as thick as the pull plate 820, so the sheet-like support rod 830 is used to firmly fix the roller shutter side plates 800 with the first side plate 200 and the second side plate 300, thereby promoting the stability when the foldable tray is used to fix articles. In addition, after the roller shutter side plates 800 are stored in the roller shutter storage apparatuses 810, the plurality of support rods 830 are not overlapped with each other because of the equidistant arrangement.

Figure 13:
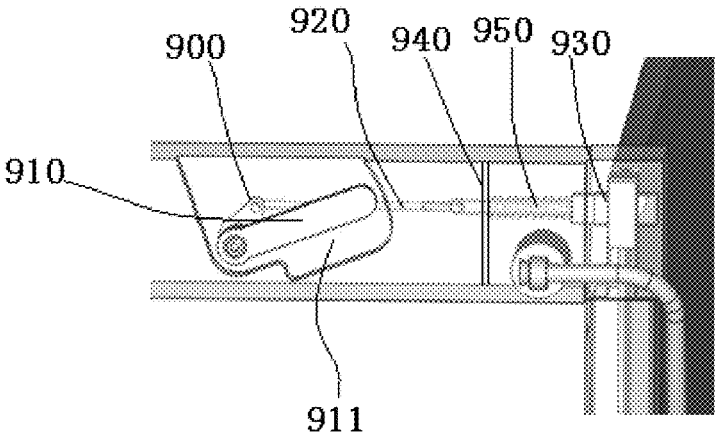
FIG. 13 is a schematic diagram of the installment of the roller shutter side plates fixed device according to the present disclosure.
Figure 14:
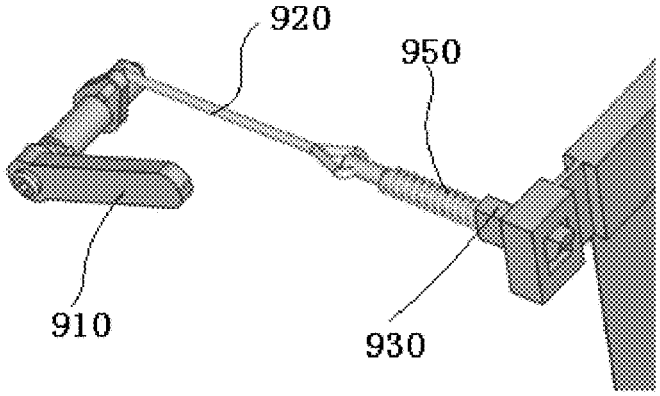
FIG. 14 is a structural diagram of a part of the roller shutter side plates fixed device according to the present disclosure.
Figure 15:
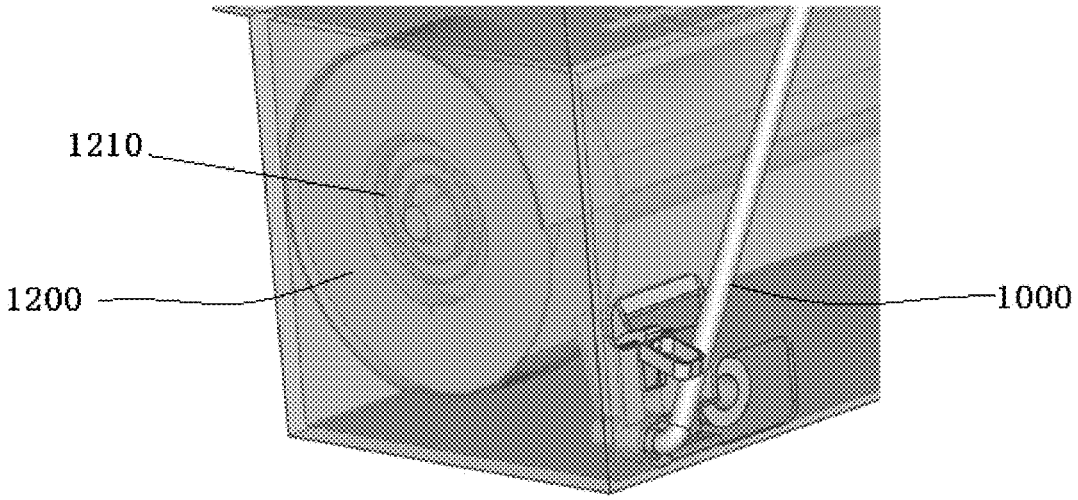
FIG. 15 is a schematic diagram of the installment of the rope storage device according to the present disclosure.
Figure 16:
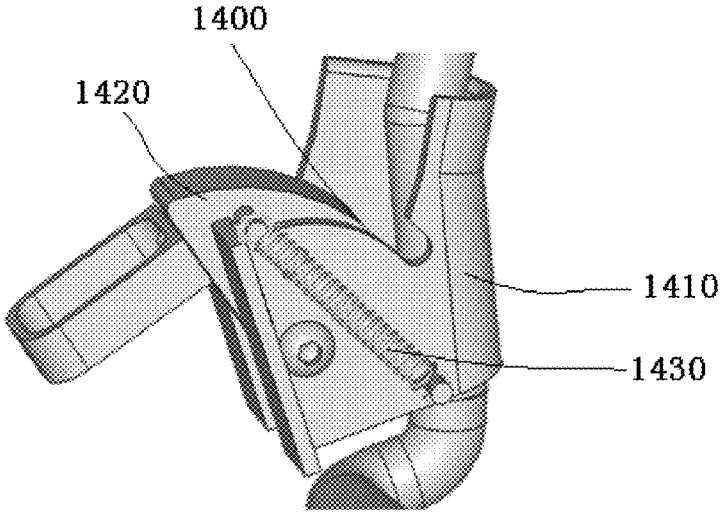
FIG. 16 is a structural diagram of the rope unidirectional limiting device according to the present disclosure in the opening state.
Figure 17:
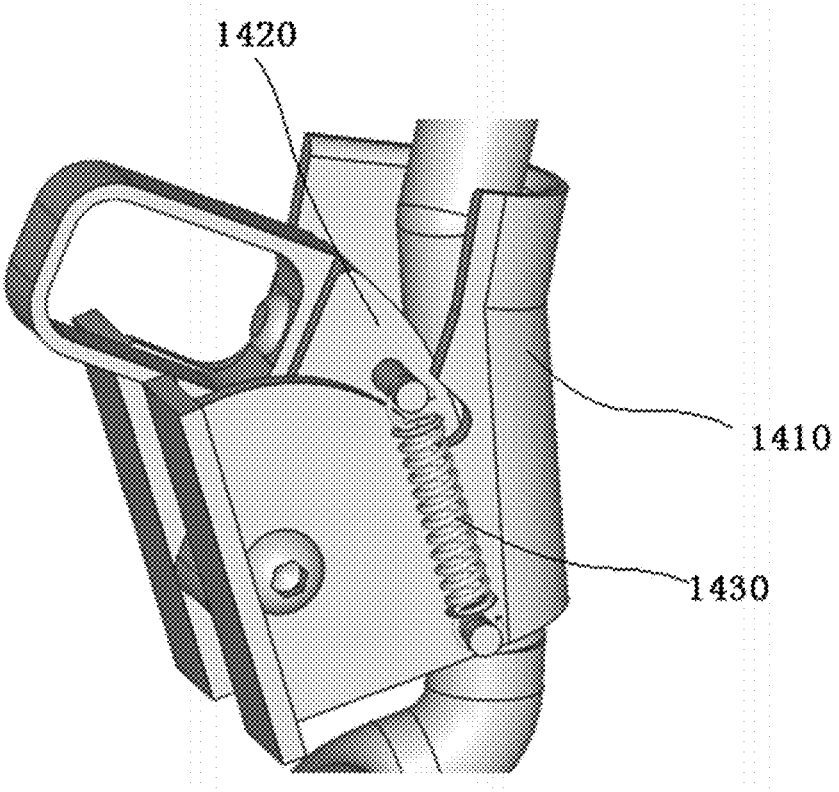
FIG. 17 is a structural diagram of the rope unidirectional limiting device according to the present disclosure in the closing state.
Figure 18:
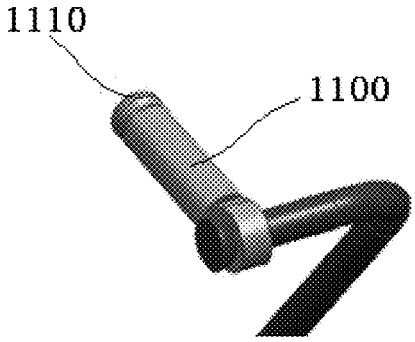
FIG. 18 is a structural diagram of the rope pin according to the present disclosure.
Figure 19:
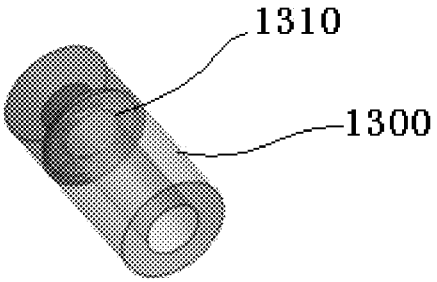
FIG. 19 is a structural diagram of the fixed component according to the present disclosure.
Figure 20:
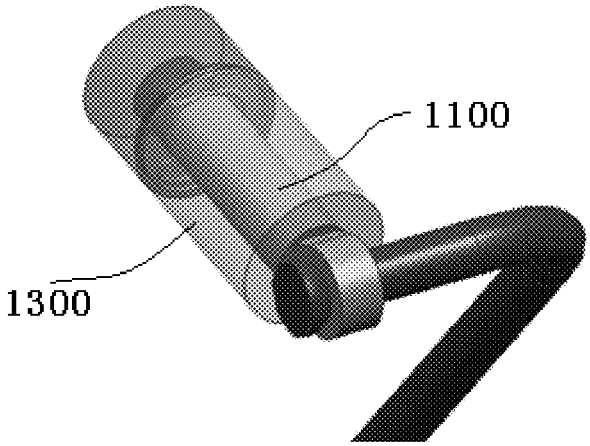
FIG. 20 is a structural diagram of the rope pin being installed with the fixed component according to the present disclosure.

As shown in FIG. 13 and FIG. 14, the foldable tray of the present disclosure further includes a roller shutter side plates fixed device 900 disposed in the drag rod 520 of the extension side plate 500. The roller shutter side plates fixed device 900 includes a handle 910, a lanyard 920 connected with the handle 910 and a lock block 930 connected with the lanyard 920. The outer side surface of the drag rod 520 is disposed with a handle recess 911 for accommodating the handle 910. The lanyard 920 and the lock block 930 are arranged in the drag rod 520. A stop block 940 is disposed between the lanyard 920 and the lock block 930. Two ends of the stop block 940 are fixed on the inner side surface of the drag rod 520. The stop block 940 has an opening thereon, and the lanyard 920 passes through the opening on the stop block 940 to connect to the lock block 930. The lanyard 920 is disposed with a spring 950 arranged in a region between the stop block 940 and the lock block 930. The lower end surface of the lock block 930 is an arc shape. When the roller shutter side plates 800 are pulled to a predetermined position and then need to be positioned, the lock block 930 is embedded in the lock hole 823 at the extension end of the pull plate 820 of the roller shutter side plates 800. The lower end surface of the lock block 930 is an arc shape, so that a smaller drag force is generated when the lock block 930 is embedded in the lock hole 823 at the extension end of the pull plate 820 of the roller shutter side plates 800. When the roller shutter side plates 800 need to be rolled, the handle 910 is rotated, the lanyard 920 is driven to move by the handle 910, and then the lanyard 920 pulls the lock block 930 out of the lock hole 823 at the extension end of the pull plate 820, so that the roller shutter side plates 800 is rolled. After the roller shutter side plates 800 are rolled, the lock block 930 bounces back under the restoring force generated by the spring 950 for the preparation of fixing the roller shutter side plates 800 again.

As shown in FIG. 15 to FIG. 20, the foldable tray of the present disclosure further includes a rope 1000 for supporting the enclosure wall formed by the foldable tray. The pull-out end of the rope 1000 is provided with a rope pin 1100. When the rope 1000 is not in use, the rope 1000 is rolled in a rope storage device 1200. The rope storage device 1200 is arranged in the baseplate 100. In addition, a turbine spring 1210 is used in the rope storage device 1200, so that the rope 1000 can retract automatically when the rope 1000 is not in use.

When the rope 1000 is in use, a rope fixer is necessary to fix the rope 1000. The rope fixer used in the present disclosure includes a fixed component 1300 and a rope unidirectional limiting device 1400 disposed on the foldable tray. The fixed component 1300 is embedded on the drag rod 520 of the extension side plate 500 and on the baseplate 100, and the fixed component 1300 on the drag rod 520 and the rope storage device 1200 are arranged in a systematically staggered manner. The fixed component 1300 is used to fix the rope pin 1100. The rope unidirectional limiting device 1400 is arranged at the exit of the rope 1000, and includes a clamping member 1410 through which the rope 1000 can pass, an eccentric wheel 1420 having a handle arranged in the clamping member 1410, and a spring 1430 of which one end is connected with the clamping member 1410 and the other end is connected to the eccentric wheel 1420. The eccentric wheel 1420 is rotatable in the clamping member 1410 through a rotating axis. The contact surface where the eccentric wheel 1420 contacts with the rope 1000 is an arc-shaped structure having a small diameter in the upper part and a large diameter in the lower part. Such a structure is capable of preventing the rope 1000 from being pulled out under the action of external force easily, thereby promoting the fixing stability. Furthermore, the arc-shaped surface has a protrusion, and the protrusion can increase the friction between the rope 1000 and the eccentric wheel 1420, thus providing an anti-skid effect and further limiting the rope 1000 to be pulled out under the action of external force. When the spring 1430 is stretching, the eccentric wheel 1420 is far away from the rope 1000, so that the rope 1000 can be pulled out freely. When the spring 1430 retracts, the eccentric wheel 1420 returns to its original position and abuts against the rope 1000 for limiting the position of the rope 1000.

The end of the rope pin 1100 is disposed with a slot 1110. The fixed component 1300 is a hollow cylindrical structure, and a clamp spring 1310 is fixed on the inner wall of the hollow cylindrical structure. When the rope 1000 is pulled out of a predetermined position and needs to be fixed, the rope pin 1100 is inserted into the fixed component 1300, and then the clamp spring 1310 is clamped in the slot 1110. The arrangement of the slot 1110 and the clamp spring 1310 can prevent the rope 1000 from the displacement caused by the action of external force, thereby promoting the stability of fixing articles. Here, as long as the rope 1000 can provide the fixed effect, the connection between the rope pin 1100 and the fixed component 1300 is not limited to the design of the clamp spring 1310 and the slot 1110, and unnecessary details are not repeated herein.

As shown in FIG. 10, a movable cross rod 550 disposed on the extension side plate 500 of the present disclosure can further be used to fix articles. The movable cross rod 550 includes a cross rod 551 sleeved on the thin tube 530 of the extension side plate 500 and a long rope 552 used to connect the cross rod 551 in an equidistant manner. The position where the cross rod 551 passes through the thin tube 530 is provided with a through hole 551*a* through which the cross rod 551 can move up and down along the thin tube 530. The left and right ends of the cross rod 551 are not in contact with the thin outer side frame 510. Two long ropes 522 are provided, and are respectively connected to the left and right ends of the cross rod 551. The top of the long rope 522 is connected to the drag rod 520, and the bottom of the long rope 552 is connected to the end of the lowermost cross rod 551. When the extension side plate 500 is in the original position, that is, before being stretched, a plurality of cross rods 551 are overlapped. When the extension side plate 500 is stretched, the plurality of cross rods 551 fix articles under the function of the long ropes 522.

The working principle of the present disclosure is as follows.

When using the foldable tray of the present disclosure, if the height of an article to be loaded is higher the height of the first side plate 200 and the second side plate 300, the prepositioning apparatus is employed to adjust the height of the first side plate 200 and the second side plate 300, and the operation is as below. The spanner 610 is rotated, and then the fixed block 620 is driven to rotate by the spanner 610. The fixed block 620 and the steel rod 630 have an angle difference therebetween, so the steel rod 630 at two ends of the fixed block 620 can be pulled out of the prepositioning hole 511, and the spring 660 is compressed between the sleeve ring 640 and the cover plate 650. When the extension side plate 500 is lifted up to a predetermined height, the spanner 660 is loosened. Due to the reset action of the spring 660, the end of the steel rod 630 is clamped in the prepositioning hole 511 to provide the positioning effect. When the extension side plate 500 is lifted up to the predetermined height, the movable cross rod 550 on the extension side plate 500 is also stretched. Then the article is loaded. When loading the article is completed, the roller shutter side plates 800 enclose the article in the foldable tray, and the operation is as follows. The pull plate 820 of the roller shutter side plates 800 is pulled, the roller shutter side plates 800 are pulled out of the roller shutter storage apparatuses 810 by the pull plate 820, and the pull plate 820 moves upwardly along the rectangular clamping groove 540 of the thick outer side frame 240 and the thin outer side frame 510. When the roller shutter side plates 800 are pulled to a predetermined position and need to be positioned, the lock block 930 of the roller shutter side plates fixed device 900 is embedded in the lock hole 823 of the extension end of the pull plate 820 of the roller shutter side plates 800. The lower end surface of the lock block 930 is an arc shape, so that a smaller drag force is generated when the lock block 930 is embedded in the lock hole 823 at the extension end of the pull plate 820 of the roller shutter side plates 800. After that, the rope 1000 is employed to fix the article, and the operation is as below. The rope pin 1100 is taken out of the fixed component 1300 on the baseplate 100, and the handle 910 of the eccentric wheel 1420 is pulled to make the eccentric wheel 1420 not contact with the rope 1000. When the rope pin 1100 is pulled to a predetermined position, the rope pin 1100 is inserted into the fixed component 1300 on the drag rod 520 of the extension side plate 500 for providing the fixed effect, then the handle 910 of the eccentric wheel 1420 is loosened, and the eccentric wheel 1420 returns to its original position under the action force of the spring 1430 and abuts against the rope 1000 for limiting the position of the rope 1000. When unloading the article, the rope 1000 needs to be retracted, and the operation is as below. The rope pin 1100 is pulled out of the fixed component 1300 on the drag rod 520 of the extension side plate 500, the rope 1000 retracts automatically under the action force of the turbine spring 1210, and the rope pin 1100 is then inserted into the fixed component 1300 on the baseplate 100. Afterwards, the roller shutter side plates 800 are rolled to be stored, and the operation is as follows. The handle 910 is rotated to drive the lanyard 920 to move, and then the lanyard 920 pulls the lock block 930 out of the extension end of the pull plate 820, so that the roller shutter side plates 800 are rolled. After the roller shutter side plates 800 are rolled, the lock block 930 bounces back under the restoring force generated by the spring 950 for the preparation of fixing the roller shutter side plates 800 again. Then the extension side plate 500 is retracted, and the following is the operation. The spanner 610 is rotated, and then the fixed block 620 is driven to rotate by the spanner 610. The fixed block 620 and the steel rod 630 have an angle difference therebetween, so the steel rod 630 at two ends of the fixed block 620 can be pulled out of the prepositioning hole 511, and the two extension side plates 500 are respectively retracted into the first side plate 200 and the second side plate 300 under the action of external force. When the extension side plates 500 are descending, each movable cross rod 550 is also descending, and then the cross rods 551 are all overlapped. After that, the first side plate 200 and the second side plate 300 are folded on the baseplate 100 in an overlapped manner, and the operation is as follows. The user steps the pedal surface 711, the pedal surface 711 moves downwardly and the spring 770 is compressed, then the foot lever 710 drives the lanyard 740 to retract, and the lanyard 740 pulls the lock buckle 750 out of the bayonet 111 of the L-shaped baffle plate 110, so that the first side plate 200 and the second side plate 300 are able to be folded. Because the first side plate 200 and the second side plate 300 lieon the baseplate 100, multiple trays can be stacked to occupy a small space in storage.

The above-mentioned descriptions represent merely the exemplary embodiment of the present disclosure, without any intention to limit the scope of the present disclosure thereto. Various equivalent changes, alterations or modifications based on the claims of the present disclosure are all consequently viewed as being embraced by the scope of the present disclosure.

What is claimed is:

1. A foldable tray, comprising a baseplate, and a first side plate and a second side plate arranged on two opposite sides of the baseplate; wherein the first and second side plates are both hingedly connected to the baseplate, and lie on the baseplate after being folded in an overlapping manner;

wherein, the first and second side plates are height-adjustable, an extension side plate that is stretched out from the interior of the side plate is arranged at the top of each of the first and second side plates; the stretching height of the extension side plate is controlled by a prepositioning apparatus arranged in each of the first and second side plates; a movable cross rod is disposed on the extension side plate for fixing an article;

wherein, a side plate folding lock is arranged on each of the first and second side plates for the control of opening and closing the first and second side plates;

wherein the tray further comprises roller shutter side plates arranged on the other two opposite edges of the baseplate; the roller shutter side plates are rolled in roller shutter storage apparatuses located in the baseplate, and are pulled out under the action of an external force, and when the external force disappears, the roller shutter side plates automatically retract.

2. The foldable tray according to claim 1, wherein the hinge joint of the first side plate and the baseplate is lower than the hinge joint of the second side plate and the baseplate, and a height difference between the hinge joints is equal to the thickness of the first side plate.

3. The foldable tray according to claim 1, wherein the prepositioning apparatus comprises a spanner, a fixed block disposed on the spanner, a steel rod connected with two ends of the fixed block, and a steel rod resetting apparatus disposed at two ends of the steel rod; an angle between the fixed block and the steel rod is in the range from 0° to 90°; wherein a plurality of prepositioning holes are arranged at two sides of the extension side plate at intervals; the end of the steel rod of the prepositioning apparatus is clamped in an uppermost prepositioning hole when the extension side plate is in an original position; when the extension side plate needs to be lifted up, the spanner is rotated to enable the steel rod of the prepositioning apparatus to detach from the prepositioning hole; and when the extension side plate is lifted up to a predetermined height, the spanner is loosened, so that the end of the steel rod is clamped in the prepositioning hole to provide the positioning effect because of the function of the steel rod resetting apparatus.

4. The foldable tray according to claim 1, wherein the side plate folding lock comprises a foot lever, a spacing ring sleeved in the middle of the foot lever, two turning wheels arranged at two opposite sides of the foot lever, two lanyards connected with the foot lever, and a lock buckle arranged at two ends of the lanyard; wherein the foot lever is movable up and down in the spacing ring; a spring is disposed between the foot lever and the spacing ring; one end of the lanyard is fixedly arranged at the bottom of the foot lever and the other end of the lanyards is connected to the lock buckle through the turning wheels; wherein a block sheet is disposed between the lock buckle and the lanyard, and the lanyards pass through the block sheet to connect with the lock buckle; wherein a portion of the lanyard between the block sheet and the lock buckle is sleeved with a spring; when the first side plate and the second side plate are in an opening state, one end of the lock buckle is clamped in the tray, so that the first side plate and the second side plate are not foldable; and when stepping the foot lever, the foot lever drives the lanyard to retract, and the lanyard pulls the lock buckle out of the foldable tray, so that the first side plate and the second side plate are foldable.

5. The foldable tray according to claim 1, further comprising a roller shutter side plates fixed device disposed in the drag rod of the extension side plate; wherein the roller shutter side plates fixed device comprises a handle, a lanyard connected with the handle, and a lock block connected with the lanyard; wherein a stop block is disposed between the lanyard and the lock block, the lanyard passes through the stop block to connect with the lock block, and the lanyard is disposed with a spring arranged in a region between the stop block and the lock block.

6. The foldable tray according to claim 1, further comprising a rope for supporting an enclosure wall of the foldable tray; wherein the pull-out end of the rope is provided with a rope pin; when the rope is not in use, the rope is rolled in a rope storage device; and wherein a turbine spring is used in the rope storage device, so that the rope retracts automatically when the rope is not in use.

7. The foldable tray according to claim 6, wherein the foldable tray further comprises a rope fixer, and wherein the rope fixer comprises a fixed component and a rope unidirectional limiting device disposed on the foldable tray; wherein the fixed component is used to fix the rope pin, and the rope unidirectional limiting device is arranged where the rope exits and comprises a clamping member through which the rope passes, an eccentric wheel with a handle being arranged in the clamping member, and a spring of which one end is connected to the clamping member and the other end is connected to the eccentric wheel, and wherein the eccentric wheel is rotatable in the clamping member around a rotating axis; when the spring is stretching, the eccentric wheel is away from the rope, and the rope is pulled out, and when the spring retracts, the eccentric wheel returns to its original position and abuts against the rope for limiting the position of the rope.

8. The foldable tray according to claim 5, wherein a lower end surface of the lock block is in an arc shape.

9. The foldable tray according to claim 7, wherein an end of the rope pin is disposed with a recess, the fixed component is a hollow cylindrical structure, and a clamp spring is provided on the inner wall of the hollow cylindrical structure.

10. The foldable tray according to claim 7, wherein a contact surface where the eccentric wheel contacts with the rope is an arc-shaped structure having a small diameter in the upper part and a large diameter in the lower part.

* * * * *